US005309981A

United States Patent [19]

Binder

[11] Patent Number: 5,309,981

[45] Date of Patent: May 10, 1994

[54] HEATED CABINET

[76] Inventor: Peter M. Binder, Saentisstrasse 74A, D-7770 Ueberlingen, Fed. Rep. of Germany

[21] Appl. No.: 886,288

[22] Filed: May 21, 1992

[30] Foreign Application Priority Data

May 21, 1991 [DE] Fed. Rep. of Germany ..... 4116500

[51] Int. Cl.[5] ..... F24C 7/06

[52] U.S. Cl. ..... 265/64; 126/21 A; 219/400; 165/61

[58] Field of Search ..... 219/400, 385, 386, 407; 126/21 A, 21 R; 165/61, 64

[56] References Cited

U.S. PATENT DOCUMENTS

| | | | |
|---|---|---|---|
| 3,160,153 | 12/1964 | Drayer | 126/21 A |
| 4,515,143 | 5/1985 | Jabas | 219/400 |
| 4,585,923 | 4/1986 | Binder | 219/400 |
| 4,913,223 | 4/1990 | Mizuno et al. | 165/61 |

FOREIGN PATENT DOCUMENTS

| | | |
|---|---|---|
| 2618998 | 11/1977 | Fed. Rep. of Germany . |
| 3329855 | 4/1984 | Fed. Rep. of Germany . |
| 3407458 | 9/1984 | Fed. Rep. of Germany . |
| 2-124078 | 5/1990 | Japan . |

*Primary Examiner*—Martin P. Schwadron
*Attorney, Agent, or Firm*—Mason, Fenwick & Lawrence

[57] ABSTRACT

A heating cabinet includes a fan (24) by means of which air is drawn out of the inner housing into an air chamber (22). From the air chamber (22) the air is directed through a preheating chamber (28) of U-shaped cross-section, comprising a heating element (34), enclosing the inner housing, and is directed back into the usable space through apertures (36) in the side walls (16) of the inner housing. Air guidance plates (38) are attached externally on the side walls (16) which compel the air to flow along the entire length of the heating element (34) before it can pass out through the apertures (36). In this manner, temperature differences between the air passing through the different apertures (36) are avoided and localized temperature variations in the usable space are minimized.

10 Claims, 3 Drawing Sheets

Fig. 1
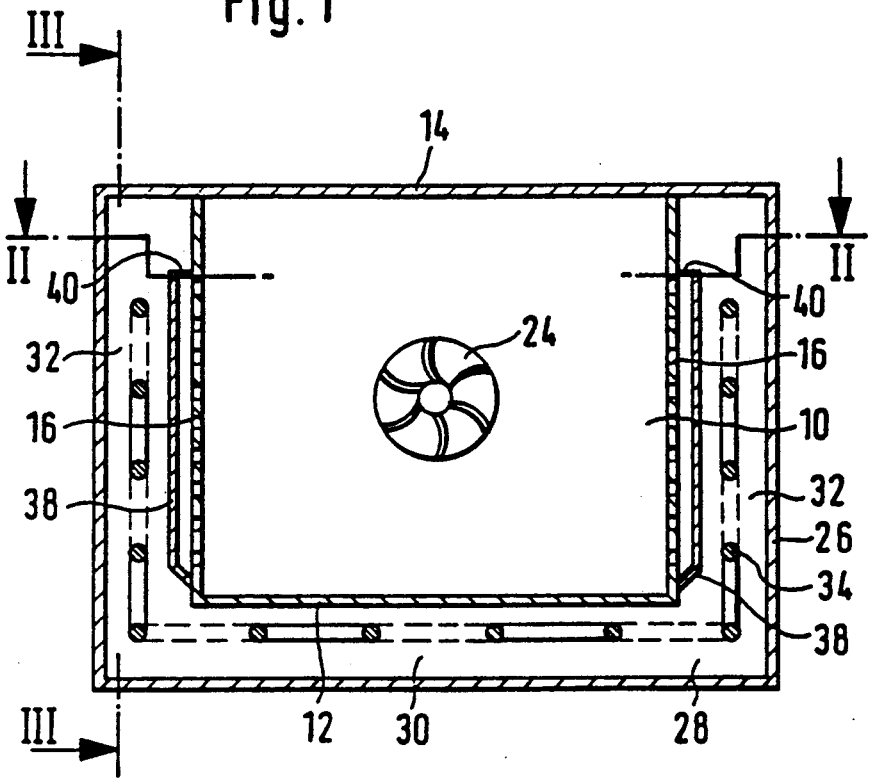
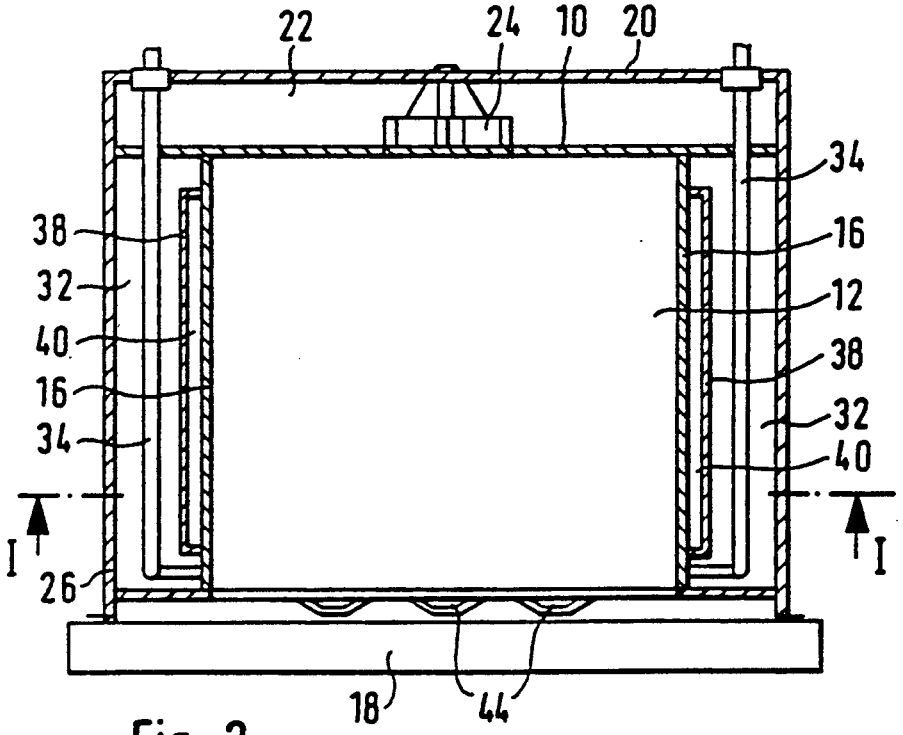
Fig. 2

HEATED CABINET

The invention relates to heated cabinets, in particular but not exclusively to so-called "hot cabinets" for use in laboratories.

A laboratory hot cabinet of this kind is known from DE 33 29 855 C2. In the case of this known hot cabinet air is sucked out of the usable space into an air chamber at the rear by means of a fan. The fan delivers the air from this air chamber into a preheating chamber which has a U-shaped cross section and encloses the inner housing of the hot cabinet. A heating element is arranged in the preheating chamber. The air flows along this heating element and passes through apertures in the side walls of the inner housing from the preheating chamber into the usable space in the inner housing. While the air flows through the preheating chamber along the heating element it is heated by the heating element, and a regulator controls the temperature of the heating element in accordance with the air temperature measured in the usable space. The apertures distributed over the surfaces of the side walls cause a uniform distribution of the air flowing into the usable space in the inner housing in order to maintain a constant temperature in the usable space with the smallest possible local variation.

Despite the uniform distribution of the inflowing preheated air, the known hot cabinet still shows considerable localized temperature variations or temperature gradients on measuring the spatial temperature distribution in the usable space, for example in accordance with DIN 12880.

Thus it would be desireable to provide an improved laboratory hot cabinet such that the spatial temperature variations in the usable space within the cabinet are substantially reduced.

According to the present invention, there is provided a cabinet comprising a housing defining a useable space and having at least one aperture for the entry of heated air into the useable space, heating means located outside the housing; and means for directing a flow of air over said heating means and into the useable space through said aperture, said directing means including an air guidance surface, interposed between said at least one aperture and the heating element and arranged to guide the flow of air over the heating means before the heated air passes through said at least one aperture into the useable space.

Preferably, the cabinet includes a preheating chamber arranged externally of the housing and connected with the useable space through said at least one aperture, the heating means being located within the preheating chamber.

Preferably the cabinet includes a fan arranged to draw air from the useable space into an air chamber outside the housing, the air chamber being open to the preheating chamber to allow air to flow from the air chamber to the preheating chamber.

Preferably, the housing is cuboid in shape, the preheating chamber is U-shaped in cross-section and surrounds a horizontal wall and vertical side walls of the housing, the heating means comprising a heating element which extends within the horizontal wall and vertical side walls and is spaced apart from the respective wall of the housing, the air chamber is arranged on a rear wall of the housing, and opens only into a horizontal section of the preheating chamber, the intake side of the fan opens into the rear wall of the housing and the expulsion side opens into the air chamber, and the side walls of the housing are provided with a plurality of such apertures which connect the preheating chamber with the useable space, there being two air guidance surfaces arranged respectively between the side walls and the heating means to guide the air which flows through the horizontal chamber section and then through the vertical sections of the preheating chamber over the total portion of the heating means located in the respective vertical sections of the preheating chamber.

Investigations performed in connection with the invention showed that the heating performance of the heating element arranged in the preheating chamber was subject to very marked differences over its length. Accordingly the temperature of the heating element varied considerably over its length. These temperature differences are completely unsystematic and so neither their distribution over the length of an individual heating element nor their variation from heating element to heating element can be predetermined. These temperature gradients in the longitudinal direction of the heating element, typically of up to 60° C., lead to differences in heating of the air near hotter and colder regions of the heating element. It was found that the spatial temperature variations in the usable space in a conventional hot cabinet are partially caused by the fact that air enters the usable space through apertures adjacent to regions of the heating element which are at different temperatures. In addition it was established that in the case of the conventional hot cabinet, the temperature in the upper region of the usable space is systematically slightly higher than that in the region near the floor because the air which enters into the upper region of the usable space through the apertures passes along the heating element over a longer distance in the vertical sections of the preheating chamber and therefore it is heated to a greater extent.

Consequently in accordance with the preferred embodiment of the invention air guidance surfaces are installed in the vertical sections of the preheating chamber which make it impossible for air to enter the usable space through the apertures in the side walls and directly from different regions of the heating element which can be at different temperatures. Instead the air guidance surfaces ensure that the total volume of air must first flow completely along all of the heating element in the vertical section of the chamber and only then, when distributed over the surface of the side wall, can it enter into the usable space through the apertures. All the air entering into the usable space through the apertures in the side walls has therefore flowed in the same way along all the hotter and colder regions of the heating element and has also been in contact with the heating element over the same path length and for the same duration so that all the volume of air undergoes the same heating and has the same temperature before it enters into the usable space through the apertures in the side walls of the inner housing.

Thus the temperature gradients distributed over the length of the heating element are averaged out and temperature differences resulting from different durations of contact with the heating element are avoided. Measurements showed that the spatial temperature variations in the usable space in accordance with the invention can be reduced by more than half in comparison with a conventional hot cabinet.

Surprisingly, in accordance with the invention there is not only an improvement in the constancy of the temperature throughout the space inside an individual hot cabinet, but there is also a substantially increased reproducibility of the measured value with the different units in a production series, so that in the case of serial production almost none of the hot cabinets are at the limits of the permissible tolerance or are unusable.

The additional air guidance surfaces cause a slightly higher resistance to the flow of air which is supplied into the usable space from the air chamber through the preheating chamber and the apertures in the side walls. This somewhat higher resistance to the flow of air has the further advantage that a slight right-left asymmetry of the radial fan generally used is equalized and equal volumes of air are blown into the usable space through the right and the left vertical sections of the preheating chamber. Thereby the air flow through the usable space is made even more uniform and the formation of temperature gradients in the space is counteracted.

Furthermore, as a result of the lengthened and equalized flowpaths caused by the air guidance surfaces, temperature variations over a period of time caused by the temperature regulator are equilibrated so that in comparison with a conventional hot cabinet there is also a smoother change in temperature with time.

In a preferred embodiment of the invention which has a particularly simple construction the air guidance surfaces are each formed by a single air guidance plate which is arranged parallel to and at a distance from the corresponding side wall and which blocks the direct flowpath from the heating element to the apertures in the side wall. The air guidance plate is connected in a sealing manner to the side wall at its edge on the inflow side and at its two vertical side edges, and only leaves a gap free for entry of air to the apertures in the side wall at its edge furthest from the inflow. The air delivered from the rear air chamber through the horizontal section of the preheating chamber must therefore flow first outside the air guidance plate along the total extent of the heating element and only then can it flow in between the air guidance plate, at its end furthest from the inflow into the preheating chamber, and the side wall and then through the apertures into the usable space.

Preferably air outlet apertures which are not covered by air guidance surfaces are arranged on the vertical edges of the side walls adjacent to the side of the inner housing at which the door opens. Similarly air outlet apertures may be arranged on the edge of the horizontal section of the preheating chamber adjacent to the side at which the door opens. Air with a slightly higher flow velocity is blown along the door surface through these additional air outlet apertures. Thereby a "curtain" of hot air is formed on opening the door which prevent too great ar exchange of air between the usable space and the external space and a resultant temperature drop. Furthermore the hot-air curtain blown against the door surface heats the door and thereby prevents the door acting as an escape for heat which disturbs the temperature conditions in the usable space.

If the laboratory hot cabinet is also to be used as a combined cooling-heating cabinet or as a controlled temperature cabinet, then in a preferred further development of the invention the evaporator of a cooling apparatus may be arranged in the rear air chamber. The air sucked out of the usable space by the fan flows past the evaporator nd is cooled by this before it enters the preheating chamber. In the preheating chamber the cooled air is heated to the temperature desired inside the usable space by means of the temperature controlled heating element. The advantageous action of the air guidance surfaces is also employed here.

The invention is described by way of example with reference to an embodiment shown in the following drawings, in which:

FIG. 1 shows a vertical cross-section through a laboratory hot cabinet along the line I—I in FIG. 2.

FIG. 2 shows a horizontal cross-section through the laboratory hot cabinet along the line II—II in FIG. 1.

Figure 3:
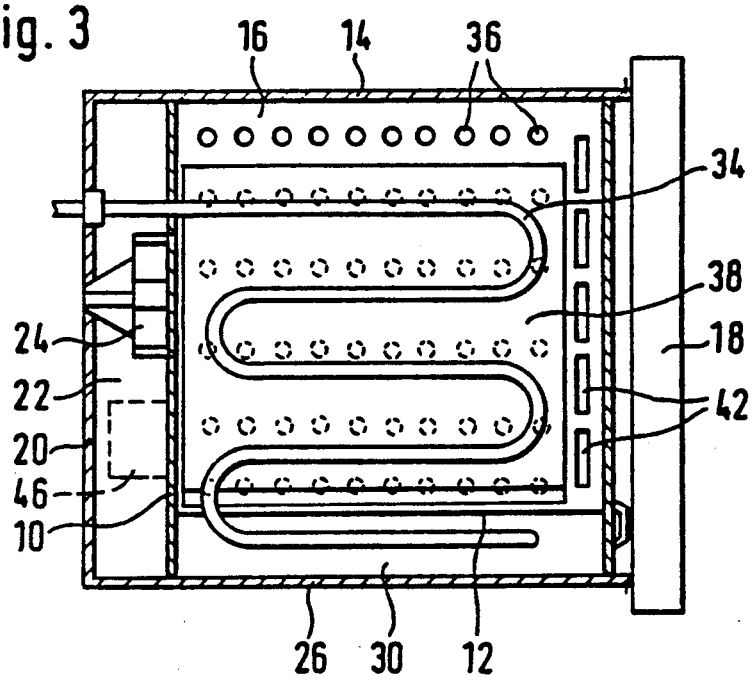
FIG. 3 shows a vertical cross-section through the laboratory hot cabinet along the line III—III in FIG. 1.

In the drawings only the elements of the laboratory hot cabinet necessary to describe the invention are shown schematically. The other elements of the laboratory hot cabinet are constructed in a know conventional manner and so are not shown in the drawings or described further. This relates in particular to the outer casing of the hot cabinet, the heat insulation, the electrical connections, the temperature sensor and temperature control, and also to the elements for guiding shelf inserts and the like.

The hot cabinet comprises an inner housing, preferably made of stainless steel. The inner housing is cuboid and consists of a rear wall 10, a floor 12, a top cover 14 and vertical side walls 16. The front of the inner housing is open and can be closed by a heat insulated door 18.

Outside the rear wall 10, and spaced apart from the rear wall 10, there is an outer wall 20 which together with the rear wall 10, forms an air chamber 22. In the air chamber 22 a fan 24, in the form of a radial fan, is installed so that the intake opens into the internal usable space of the inner housing through an aperture made in the middle of the rear wall 10. The expulsion side of the fan 24 is located in the air chamber 22.

An outer casing 26 is provided outside and spaced apart from the side walls 16 and the floor 12, whereby preheating chamber 28 is formed having a U-shaped cross-section, which encloses the inner housing. The preheating chamber 28 consists of a horizontally extending section 30 of the chamber 28 located under the floor 12 and vertically extending sections 30 of the chamber 28 located adjacent the sides of the side walls 16. The air chamber 22 is closed on all sides and, except for the inlet opening of the fan 24, is open only at the bottom opposite the horizontal section 30 of the preheating chamber 28. The preheating chamber 28 is likewise closed on all sides except for the open connection to the air chamber 22 and the air outlet apertures described later.

A heating element 34 is arranged in the preheating chamber 28. The heating element 34 is preferably a heating tube encased in stainless steel which enters through the rear wall 10 near the top in one of the vertical sections 32 of the preheating chamber 28, and extends in S-shaped bends downwards in this vertical section of the chamber 32, then through the horizontal section of the chamber 30 and then upwards again in the other vertical section of the chamber 32, and passes out again through the rear wall 10 at the upper end of the said second vertical section of the chamber 32. The heating element 34 is mounted in the preheating chamber 28 without any heat conductive contact with the side walls 16, the floor 12 or the outer casing 26. The heating element 34 is electrically heated and its temperature is controlled by a regulator (not shown) according to the actual measured temperature in the usable space in the inner housing and a desired temperature which can be preset.

In the case of inner housings having large dimensions, preferably two or more heating elements are used instead of a single heating element 34.

The side walls 16 of the inner housing comprise a plurality of apertures 36, arranged in an array distributed over all of the side wall 16, through which air from the preheating chamber 28 can enter into the usable space in the inner housing. On the outer side of each side wall 16 a respective air guidance surface or air guidance plate 38 is attached. The air guidance plates 38 extend parallel to their respective side walls 16 and are spaced apart from the latter. The air guidance plates 38 cover all the apertures 36 which are located near the heating element 34. Apertures 36 which are located above the first loop of the heating element 34 may remain uncovered by the air guidance plate 38. The air guidance plates 38 are bent at their lower edges and at their two vertical side edges towards the respective side walls 16 and are fixed by means of the bent over edges to the side wall 16, for example by spot welding. In this manner each air guidance plate 38 forms, with the respective side wall 16, a pocket-shaped chamber which is closed at its bottom edge and at the side edges and which comprises an open slot 40 at its upper end for the entry of air.

When the laboratory hot cabinet is in use, air is drawn by the fan 24 out of the usable space in the inner housing. The fan 24 discharges the air which it has drawn out radially into the air chamber 22, out of which air is forced downwards into the horizontal section 30 of the preheating chamber 28. In the preheating chamber 28 the air flows forwards and to the right and left into the horizontal section of the chamber 30 and then rises upwards in the lateral vertical sections of the chamber 32. Consequently the air flows into the horizontal section of the chamber 30 and into the vertical sections of the chamber 32 past the heating element 34 and is heated by the latter. After the air has flowed upwards in the vertical sections of the chamber 32, past the total length of the heating element 34, it can pass through the air entry slot 40 at the top between the air guidance plate 38 and the side wall 16. The heated air then enters through the apertures 36 arranged above the air guidance plate 38 and behind the air guidance plate 38 into the usable space in the inner housing. The pressure of the fan 24 also causes the air to flow downwards between the air guidance plate 38 and the side wall 16 and to be blown in a uniform distribution over all the grid of apertures 36 into the inner housing.

Near their vertical side edges adjacent to the door opening the side walls 16 also comprises a vertically extending row of air outlet apertures 42 in the form of slots, which are not covered by the air guidance plate 38. Through these air outlet apertures 42 a curtain of hot air is blown along the internal surface of the door 18. This air curtain prevents on the one hand, localized cooling through the door surface and, on the other hand, a large exchange of air on opening the door and a consequent high heat loss.

Figure 4:
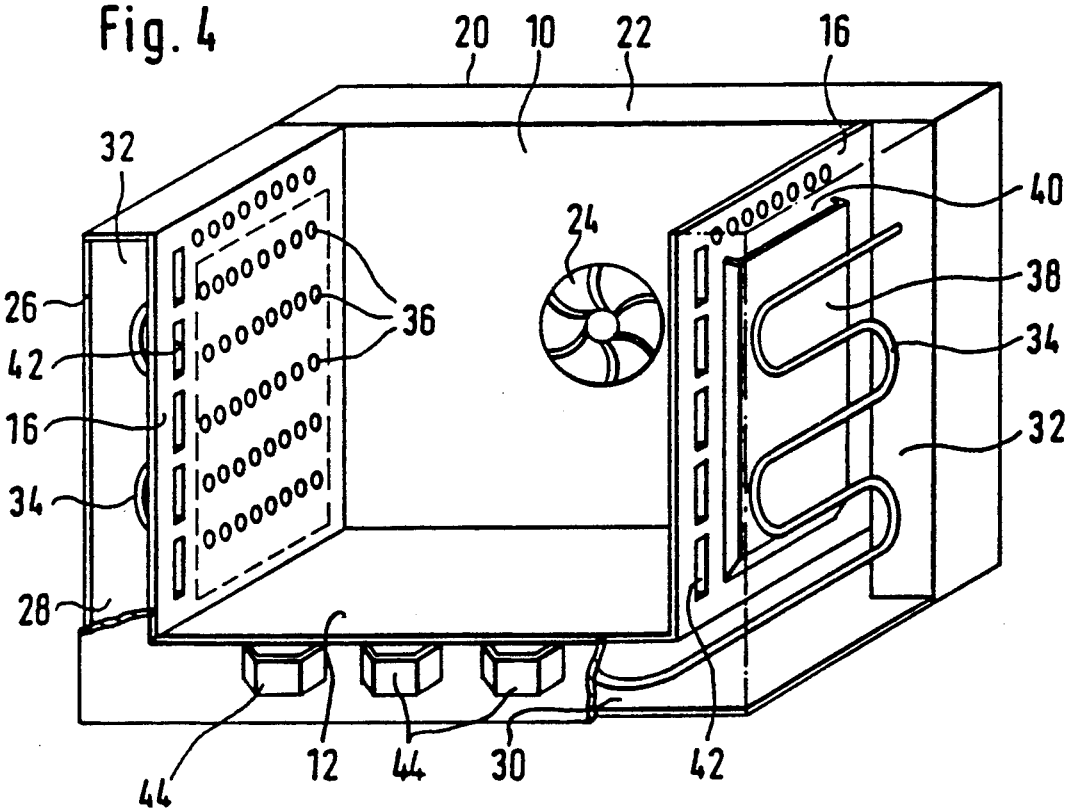
FIG. 4 shows a perspective view of the laboratory hot cabinet where the upper cover, the door, and the front wall and the outer wall of the preheating chamber have been removed.
Figure 7:
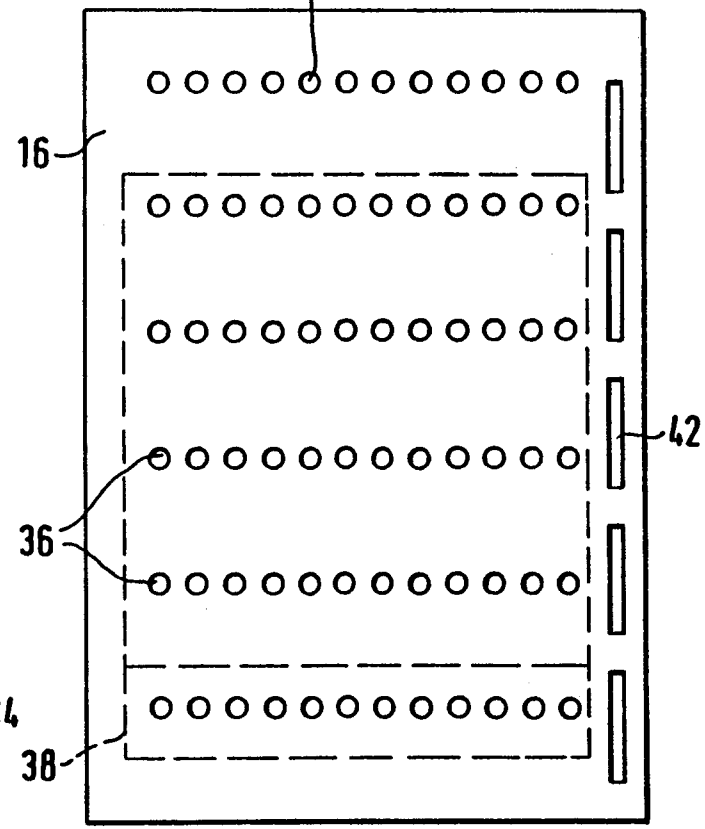
FIG. 7 shows this side wall seen in front view from inside.
Figure 6:
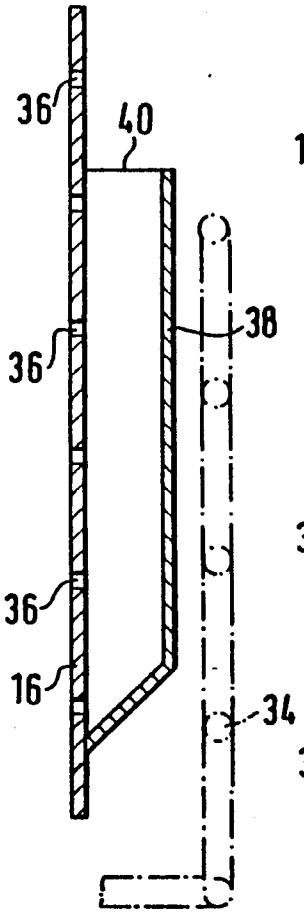
FIG. 6 shows a vertical cross-section through this side wall.
Figure 5:
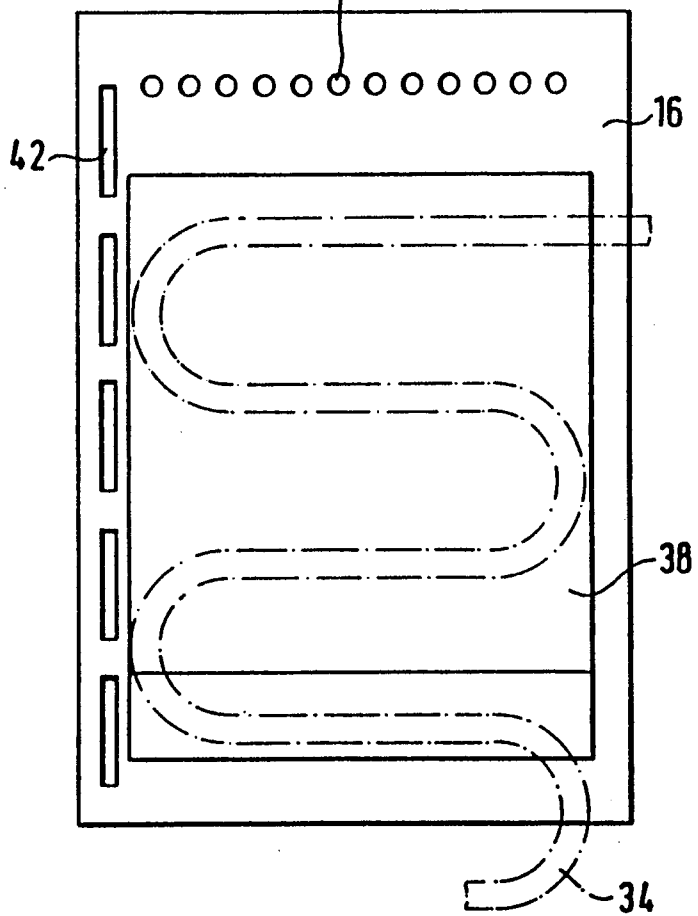
FIG. 5 shows a side wall of the inner housing seen in front view from outside.

Below the door opening of the inner housing, further air outlet apertures 44 are arranged in the front wall of the horizontal section 30 of the preheating chamber 28; this front wall is shown partially broken away in FIG. 4. These air outlet apertures 44 are formed by protrusions, formed in the front wall, which are open at the top. These protrusions cause air to be blown upwards out of the horizontal section 30 of the chamber 28 along the internal surface of the door 18 and consequently supplement the hot-air curtain near the door 18 provide by the air outlet apertures 41. Because the air outlet apertures 44 are formed in the front wall of the horizontal section of the chamber 28 and not in the floor 12 of the inner housing, any substances which may spill in the usable space in the inner housing are prevented from entering the air outlet apertures 44.

In a further development of the embodiment shown, the laboratory hot cabinet can also be constructed as a combined cooling-heating cabinet or temperature controlled cabinet. In this embodiment the evaporator 46 of a cooling apparatus, which is shown in dashed lines in FIG. 3, is arranged in the air chamber 22 below the fan 24. The other elements of the cooling apparatus, such as the compressor, heat exchanger etc. are preferably arranged in a separate housing outside the heat insulation of the cooling-heating cabinet.

In this embodiment the air drawn out of the inner housing by the fan 24 flows first through the evaporator 46 of the cooling apparatus and is cooled before it passes into the preheating chamber 28. On flowing through the preheating chamber 28 the air is then heated to the desired temperature in a controlled manner by means of the heating element 34.

I claim:

1. A heating cabinet, comprising:

(a) a cuboid-shaped inner housing having side walls, first and second opposed end walls, a rear wall, a front, and an opening at said front of said inner housing;

(b) a preheating chamber having a U-shaped cross-section comprising opposed vertically extending sections positioned outwardly of said side walls and a horizontally-extending section positioned outwardly of said first end wall;

(c) a heater in said preheating chamber positioned outwardly of and spaced from said side walls and said first end wall;

(d) a door for closing said opening;

(e) an air chamber positioned rearwardly of said rear wall, said air chamber opening into said horizontally-extending section of said preheating chamber;

(f) a fan for drawing air from said inner housing into said air chamber;

(g) first apertures in said side walls spaced from said opening for admitting a first part of heated air from said preheating chamber into said inner housing;

(h) second apertures formed in said inner chamber for admitting a second part of heated air from said preheating chamber into said inner housing; and (i) air guidance surfaces in said vertically-extending sections of said preheating chamber, said air guidance surfaces being interposed between said heating and said first apertures of said side walls and covering only said first apertures for separating the first part of heated air from the second part of heated air and for guiding a first part of the air in said preheating chamber completely over said heater before the air passes through said first apertures into said inner housing.

2. The heating cabinet of claim 1, wherein said first end wall defines a floor of said preheating chamber and said second end wall defines a top cover of said preheating chamber.

3. The heating cabinet of claim 1, and further comprising an evaporator of a cooling apparatus in said air chamber.

4. The heating cabinet of claim 1, and further comprising an air cooling element in said air chamber.

5. The heating cabinet of claim 1, said door having an internal surface, and further comprising air outlet apertures between the floor of said inner housing and the door for receiving air from said preheating chamber and delivering said air upwardly along the internal surface of said door.

6. The heating cabinet of claim 1, said air guidance surfaces each being a part of an air guidance plate which is substantially parallel to and spaced from a said side wall, each said air guidance plate being sealingly connected tot eh external surface of a said side wall along edges thereof except for one edge, said one edge being spaced from the side plate to which the air guidance plate is connected and forming therewith an air inlet slot, said air inlet slot being at a level substantially above the level of said floor of said inner housing.

7. A heating cabinet, comprising;

(a) a cuboid-shaped inner housing side walls, a floor, a top cover, and a rear wall, and an opening at the front of said inner housing;

(b) a preheating chamber having a U-shaped cross-section positioned outwardly of said side walls and beneath said floor;

(c) a heater in said preheating chamber positioned outwardly of and spaced from said side walls and beneath said floor;

(d) a door for closing said opening;

(e) an air chamber for receiving air discharged by said fan and connected to said preheating chamber to deliver air thereto, said air chamber positioned rearwardly of said rear wall and opening into said preheating chamber beneath said floor;

(f) a fan for drawing heated air through said first and second apertures and into said inner housing;

(g) first apertures in said side walls spaced from said opening for admitting heated air from said preheating chamber into said inner housing;

(h) air guidance surfaces for guiding a first part of the air over said heater before the air passes through said first apertures in said side walls, each of said air guidance surfaces including a part of an air guidance plate positioned substantially parallel to and spaced from one said side all, each said air guidance plate being sealingly connected to the external surface of one said side wall along edges thereof except for one edge, said one edge positioned spaced from said side plate to which said air guidance plate is connected and forming therewith an air inlet slot, said air inlet slot positioned at a level substantially above the level of said floor of said inner housing; and (h) second apertures in said side walls adjacent said front of said housing not being covered by said air guidance surfaces for admitting air from said preheating chamber into said inner housing adjacent said door.

8. The heating cabinet of claim 7, further comprising an evaporator of a cooling apparatus in said air chamber.

9. The heating cabinet of claim 7, further comprising an air cooling element in said air chamber.

10. The heating cabinet of claim 7, wherein said door has an internal surface, and further comprising air outlet apertures between said floor of said inner housing and said door for receiving air from said preheating chamber and delivering the air upwardly along said internal surface of said door.

* * * * *